US006401829B1

(12) United States Patent
Newton

(10) Patent No.: US 6,401,829 B1
(45) Date of Patent: Jun. 11, 2002

(54) FIRE FIGHTING APPARATUS FOR ACCESSING REMOTE WATER SUPPLIES

(76) Inventor: Ray Newton, 936 Huey P. Long Ave., Gretna, LA (US) 70053

( * ) Notice: Subject to any disclaimer, the term of this patent is extended or adjusted under 35 U.S.C. 154(b) by 24 days.

(21) Appl. No.: 09/672,482

(22) Filed: Sep. 28, 2000

Related U.S. Application Data

(60) Provisional application No. 60/156,646, filed on Sep. 29, 1999.

(51) Int. Cl.[7] ..... A62C 27/00

(52) U.S. Cl. ..... 169/24; 169/169; 169/13; 239/172; 239/724; 417/234; 417/423.3

(58) Field of Search ..... 169/24, 51, 52, 169/13; 239/172, 175, 724, 723, 722, 729, 160; 417/234, 231, 205, 423.3; 92/114

(56) References Cited

U.S. PATENT DOCUMENTS

| | | | | |
|---|---|---|---|---|
| 1,421,496 A | | 7/1922 | Klewanech | |
| 2,325,355 A | | 7/1943 | Yost | |
| 2,360,777 A | * | 10/1944 | Bour | 169/24 |
| 3,008,422 A | * | 11/1961 | Crisafulli | 417/234 |
| 3,180,423 A | | 4/1965 | Gibbs | |
| 3,759,330 A | | 9/1973 | Rainey et al. | |
| 4,070,135 A | * | 1/1978 | Eller | 417/234 |
| 4,410,045 A | * | 10/1983 | Whitman | 169/24 |
| 4,482,017 A | | 11/1984 | Morris | |
| 4,616,979 A | * | 10/1986 | Hynes et al. | 417/234 |
| 4,786,239 A | | 11/1988 | Eberhardt | |
| 4,917,193 A | | 4/1990 | Ockler | |
| 4,973,403 A | | 11/1990 | Kozey | |
| 5,135,055 A | | 8/1992 | Bisson | |
| 5,356,080 A | * | 10/1994 | Chapman | 239/724 |
| 5,797,421 A | | 8/1998 | Merrett | |

* cited by examiner

*Primary Examiner*—Henry C. Yuen
*Assistant Examiner*—Dinh Q. Nguyen
(74) *Attorney, Agent, or Firm*—Garvey, Smith, Nehrbass & Doody, LLC; Charles C. Garvey, Jr.

(57) ABSTRACT

A fire fighting apparatus includes a chassis that can be in the form of a trailer that supports a pedestal and an articulating boom with a submersible hydraulically driven pump at an end portion of the boom opposite the pedestal. A diesel engine mounted on the chassis powers both a hydraulic pump and a transfer pump. Water picked up by the submersible pump at the end of the boom is received on the chassis and then transferred under pressure to a fire fighting hose. A dual filter arrangement can be used to remove trash that is picked up by the submersible hydraulic pump. A hydraulic motor on the chassis can be used to operate the boom during unfolding and folding and to transfer hydraulic fluid to the submersible pump.

20 Claims, 9 Drawing Sheets

FIRE FIGHTING APPARATUS FOR ACCESSING REMOTE WATER SUPPLIES

CROSS-REFERENCE TO RELATED APPLICATIONS

Priority of U.S. Provisional Patent Application Ser. No. 60/156,646, filed Sep. 29, 1999, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to fire fighting equipment and more particularly, to an improved fire fighting trailer apparatus that can be easily transported (eg. on its own self propelled chassis or have a trailer chassis that can be towed with a truck to a remote site, wherein water is needed to fight a fire in areas that do not have city water systems, fire hydrants and the like.

2. General Background of the Invention

An adequate supply of water is essential for fire fighting. In many suburban/rural areas, the development of residential and commercial properties severely taxes the local fire protection system. Frequently fire fighters discover that structures are built without provisions for an adequate number of fire hydrants and water for fire fighting.

In the event that a surface water supply is available, or could easily be developed, these supplies are frequently not utilized due to lack of equipment and the delays inherent in establishing an alternate water supply. The present invention is designed to eliminate or minimize the problems associated with establishing and maintaining an alternate water supply.

BRIEF SUMMARY OF THE INVENTION

The present invention provides a device for quickly and efficiently obtaining a water supply for fire fighting. The apparatus of the present invention is especially useful in suburban and/or rural areas where water supplies from fire hydrants are weak or non-existent. The apparatus of the present invention can easily be deployed and operated by one individual, which is not possible with currently available methods, allowing more efficient utilization of available manpower.

The apparatus of the present invention provides a mobile device, consisting of a crane-like boom used to reach a water supply, a lift pump or pumps attached to the extended base of the lower boom, filters designed to trap and eliminate debris, and a transfer pump for delivering fire fighting water to a pumper, tanker or larger diameter hose or holding tank.

The apparatus of the present invention combines a number of unique features including: (1) a specially designed articulating or telescoping boom which can effectively reach horizontally, vertically and below grades; (2) the pressure pump supported at the extended end of the boom; (3) the use of easily flushed, tandem, parallel filters to ensure a clean water supply; and (4) a high capacity transfer pump to supply water to hose lines or other equipment. This transfer pump is located at or near the base of the boom. The presence of this pump is to allow the device to obtain a supply of water under positive pressure, without being dependent on the limitations of a suction pump being located at a higher elevation than the water source.

With the apparatus of the present invention, one fire fighter can position his equipment at a safe location, deploy the boom over possible obstructions, and pump water (under positive pressure) for fire fighting or other emergency needs.

Since the apparatus of the present invention is designed to quickly and efficiently be deployed using minimal manpower and deliver large quantities of water for fire fighting from otherwise unusable sources, the use of the apparatus of the present invention could save lives, property, and reduce fire insurance rates for hundreds of thousands of persons living in suburban and rural areas which have available surface water sources but lack adequate fire hydrants.

The apparatus of the present invention provides a crane-like boom attached to either a self-contained trailer towed behind a fire truck or other vehicle, or a boom can be attached directly to a chassis such as the bed of a fire truck. A lift pump that is hydraulically powered is mounted at the end of an articulating boom. The boom can be articulating or extendable (eg. telescoping).

Filters are provided that can be easily cleaned and/or designed to trap and eliminate debris before entering the system. A transfer pump delivers fire fighting water to a pumper, tanker, large diameter hose or holding tank.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 4 is an elevational end view of the first embodiment of the apparatus of the present invention showing it during use with the submersible hydraulically driven pump being placed into a water source such as a lake, river, basin, reservoir, swimming pool or the like;

DETAILED DESCRIPTION OF THE INVENTION

Figure 1:
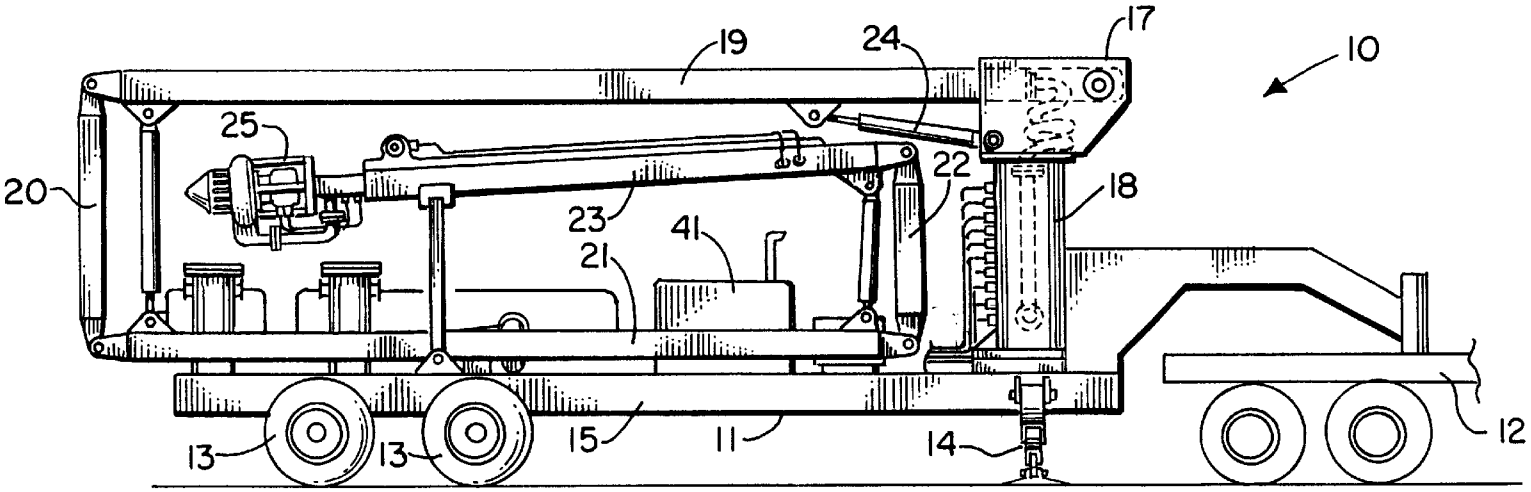
FIG. 1 is a perspective view of a first embodiment of the apparatus of the present invention.
Figure 3:
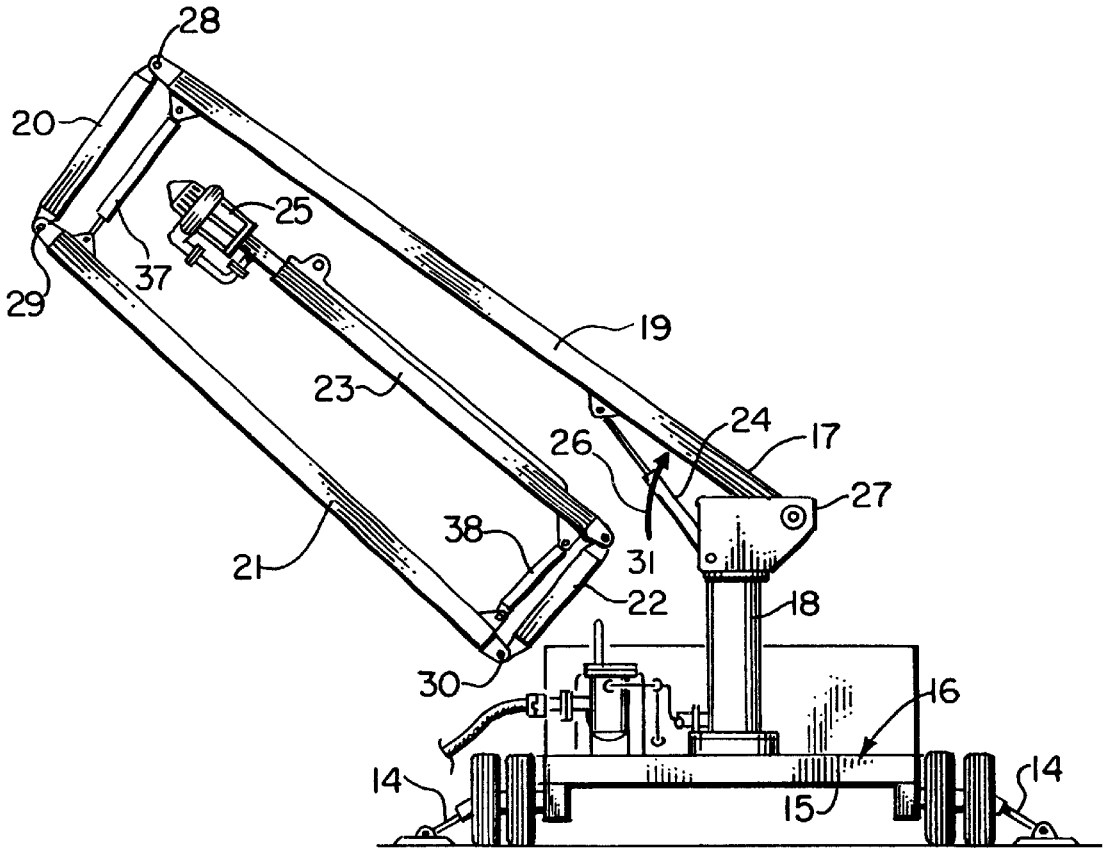
FIG. 3 is a end elevational view of the first embodiment of the apparatus of the present invention illustrating the boom and a preliminary position during a lifting of the boom and a placement of the pump.
Figure 5:
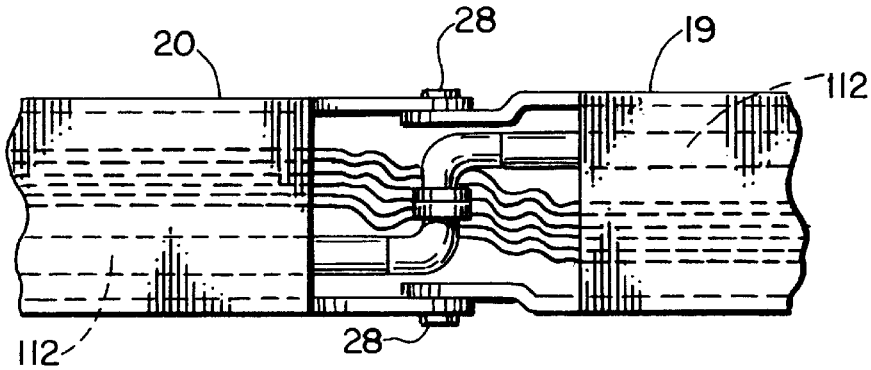
FIG. 5 is a fragmentary view of the first embodiment of the apparatus of the present invention.
Figure 4:
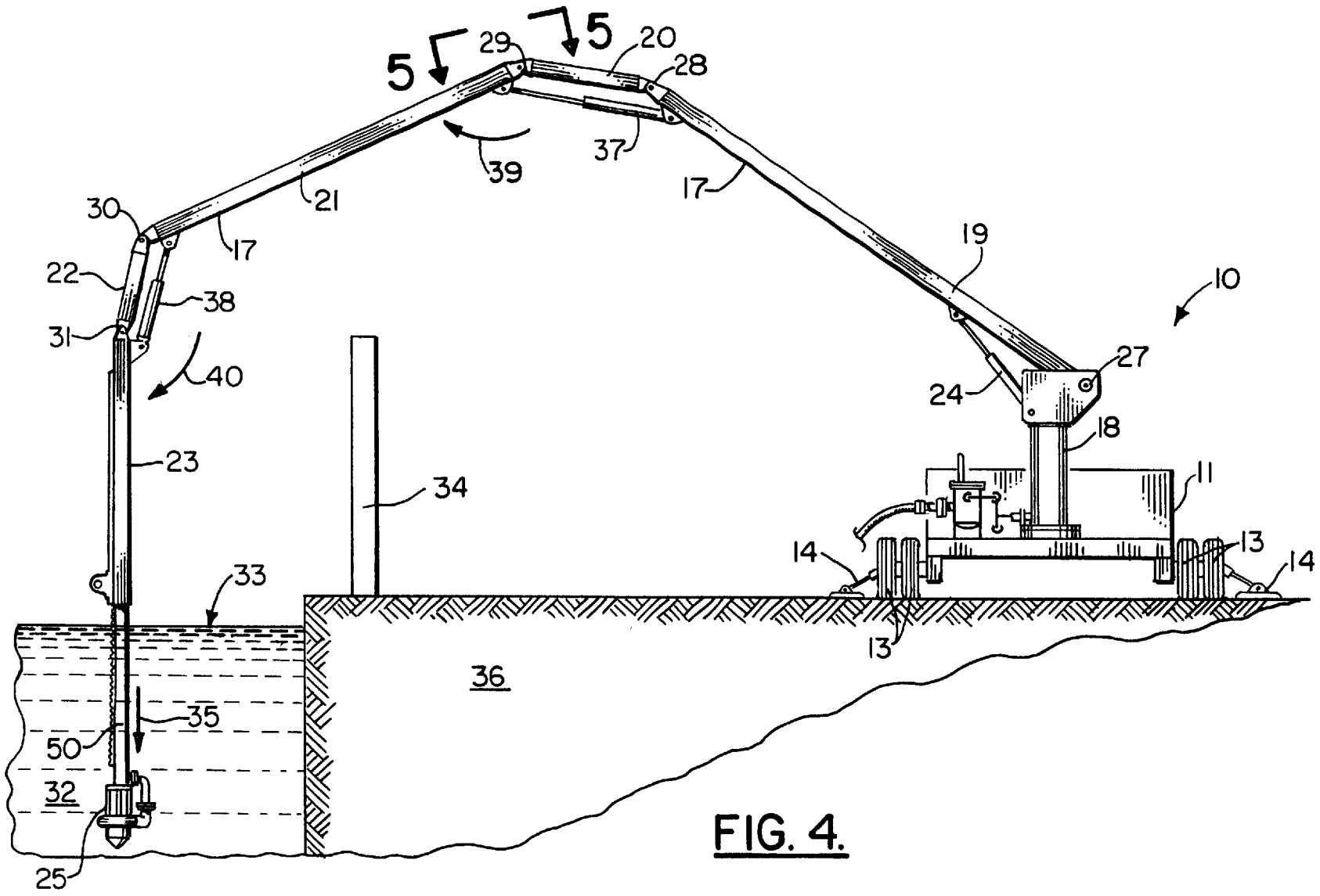

FIGS. 1, 3 and 4 show generally the first embodiment of the apparatus of the present invention designated generally by the numeral 10. Fire fighting apparatus 10 can be in the form of a trailer or truck bed 11 having a connection such as a goose neck type connection for attaching the trailer to truck 12. Alternatively, fire fighting apparatus 10 can be supported directly upon the bed of a truck as opposed to a trailer.

Trailer 11 in FIGS. 1, 3 and 4 provides a plurality of wheels 13 and outriggers 14. Frame 15 provides upper surface 16 that supports pedestal 18 and segmented boom 17. Boom 17 is comprised of a number of boom sections, 19, 20, 21, 22, 23. A hydraulic cylinder 24 lifts the first boom section 19 upwardly as shown by arrow 26 in FIG. 3. The lowest or most distal section 23 of boom 17 carries telescoping portion 50 with hydraulically driven submersible pump 25. Pivotal connections can be used to join the various boom sections 19–23 together. Also, a pivotal connection 27 can be used to join first boom section 19 to pedestal 18 as shown in FIG. 3. The additional pivotal connections between the various boom sections include pivotal connections 28, 29, 30, 31. Other hydraulic cylinders connect boom sections 19–21 and 21–23 (see FIGS. 3–4).

In FIG. 4, the apparatus 10 of the present invention is shown in an operating position wherein the pump 25 is shown in a body of water 32 having a water surface 33. In FIG. 4, a soil mass 36 is shown supporting trailer 11 next to body of water 32. Fence 34 is positioned on soil mass 36 next to body of water 32.

This schematic diagram of FIG. 4 illustrates a common problem in the fire fighting industry in rural locations. Often, an obstruction such as a fence 34 separates the fire fighters from an available source of water such as the body of water 32. The fence 34 might be surrounding a lake, pond, reservoir, swimming pool or the like. The apparatus 10 of the present invention enables a user to lift the boom 17 over fence 34 to access the body of water 32 when pump 25 is placed under water surface 33 as indicated by arrow 35 in FIG. 4.

During an unfolding of the boom 17, a plurality of hydraulic cylinders are employed. In addition to the hydraulic cylinder 24 that lifts first boom section 19 relative to pedestal 18, hydraulic cylinder 37 spans between boom sections 19 and 21. Similarly, hydraulic cylinder 38 spans between boom sections 21 and 23. As the hydraulic cylinder 37 expands, the boom sections 19 and 21 diverge as shown by arrow 39 in FIG. 4. The boom sections 21 and 23 diverge as shown by the arrow 40 in FIG. 4 as cylinder 38 expands.

Figure 7:
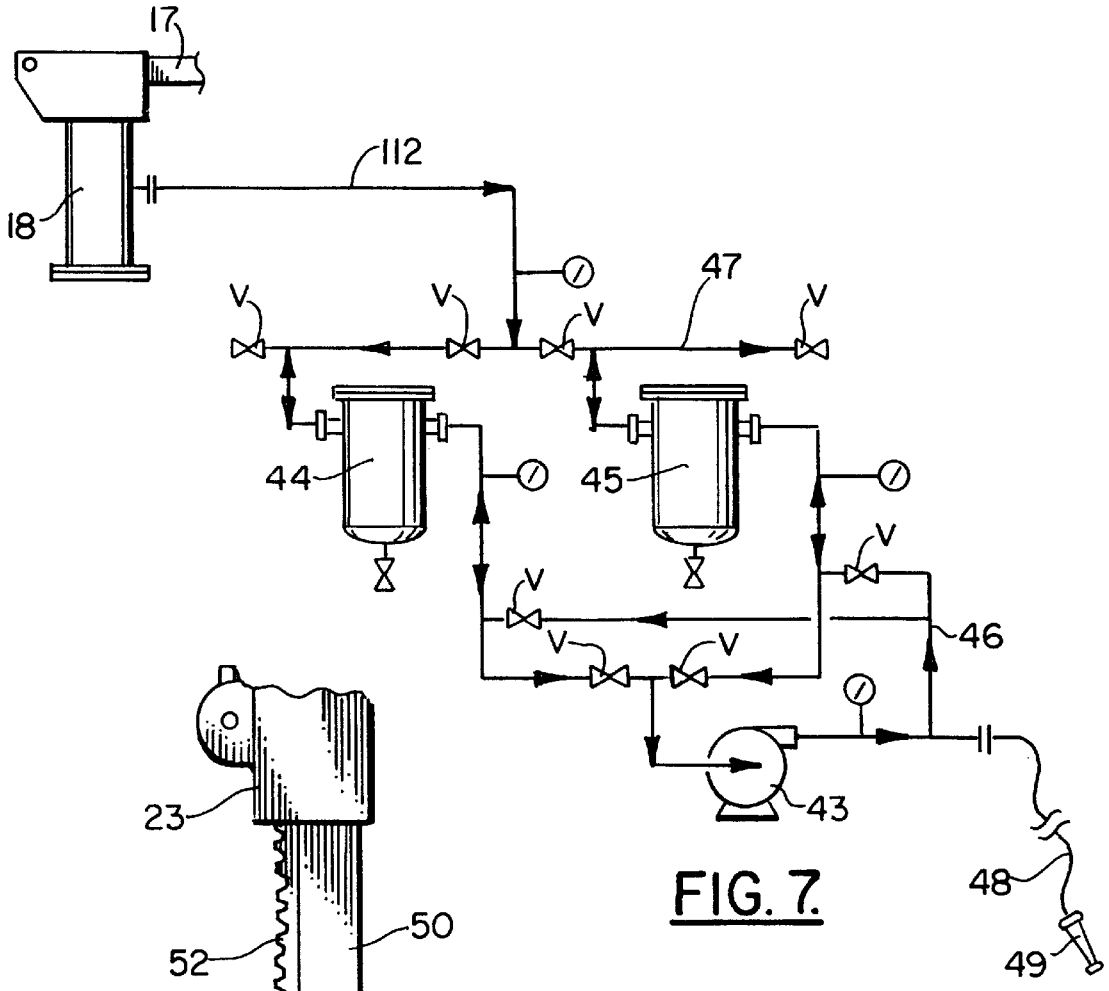
FIG. 7 is a schematic piping and instrumentation drawing of the first embodiment of the apparatus of the present invention.

The apparatus 10 of the present invention can be powered with a diesel engine 41 or like power source that powers hydraulic pump 42. Diesel engine 41 also powers transfer pump 43 that is used to transfer water received from boom 17 and pump 25 to hose 48 and nozzle 49 for fire fighting. An exemplary piping arrangement is seen in FIG. 7. The piping arrangement of FIG. 7 can also be used with the embodiment of FIGS. 9–13. A pair of filters 44, 45 can be used to filter the water that is picked up from the body of water 32 using submersible pump 25. In FIG. 7, the dual filter arrangement is shown in a piping system diagram. Flow line 46 is a backwash flowline that can be used to backwash the filters 44, 45 and discharge the back washed dirty water through an appropriate effluent flowline such as flowline 47 having a valve V. In FIG. 7, the various valves are each indicated by the letter V. Transfer pump 43 receives flow from boom 17 and pump 25 and intake flowline 112 and then through each of the filters 44, 45. Transfer pump 43 pumps water that it receives to hose 48 and nozzle 49 for fire fighting.

Figure 2:
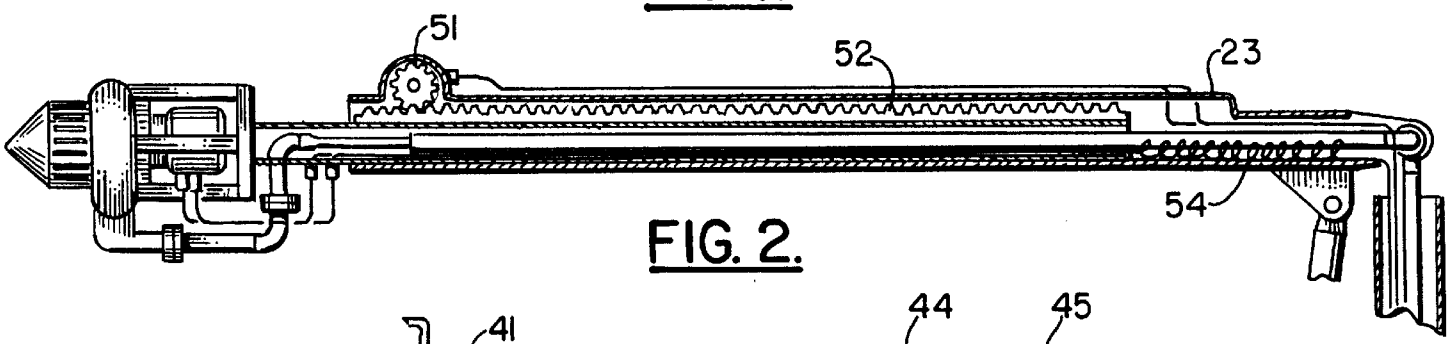
FIG. 2 is a fragmentary view of the first embodiment of the apparatus of the present invention illustrating the submersible, hydraulically driven pump and a portion of the boom.
Figure 6:
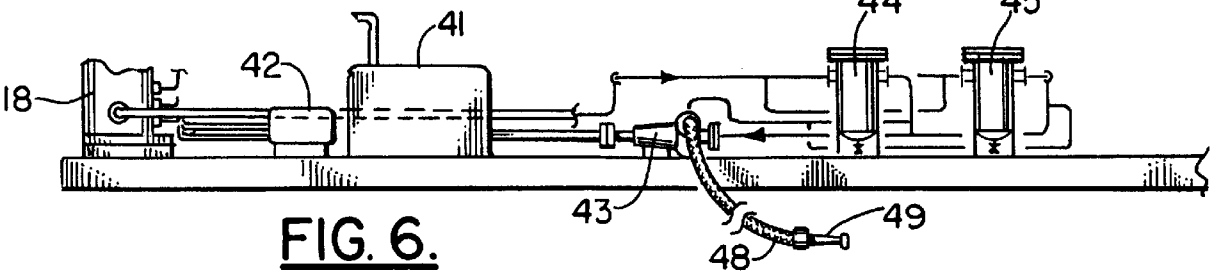
FIG. 6 is an elevational, fragmentary view of the first embodiment of the apparatus of the present invention showing the filtration system portion thereof.
Figure 8:
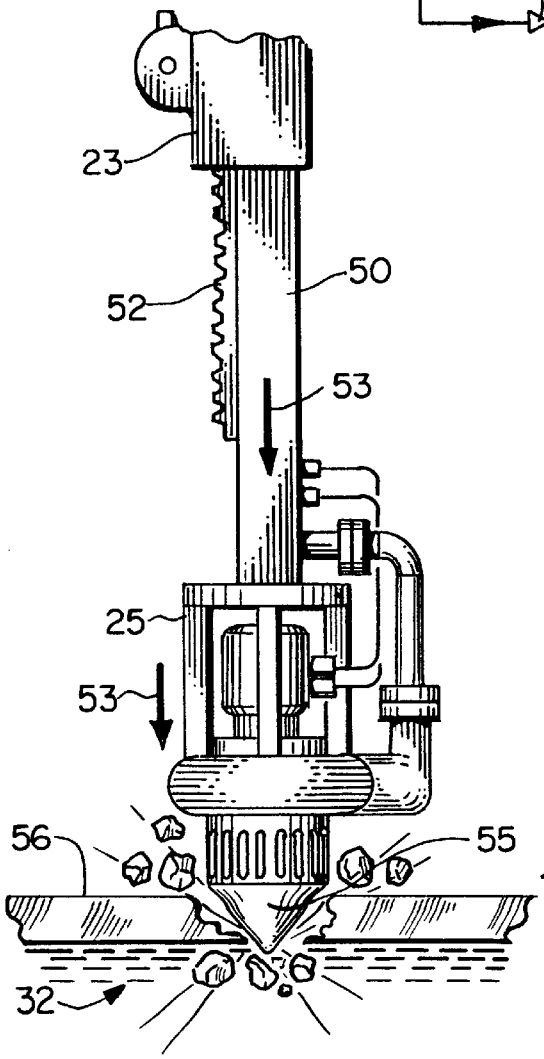
FIG. 8 is a fragmentary view of the embodiment of the apparatus of the present invention showing the lower end portion of the boom, the submersible, hydraulically driven pump, and the tip portion of the pump breaking through ice in order to access the underlying water.

In order to reach deeper into the body of water 32, a telescoping portion 50 can be provided in section 23 of boom 17. Pinion gears 51 engages rack 52 of telescoping portion 50 in order to lower the telescoping portion 50 as shown by arrows 53 in FIG. 8. When telescoping portion 50 is fully retracted within boom section 23, hydraulic hose 54 likewise retracts into a coiled position as shown in FIG. 2. The lower end of the pump 25 can provide a pointed tip 55 that can be used to break through ice 56 as shown in FIG. 8.

Figure 9:
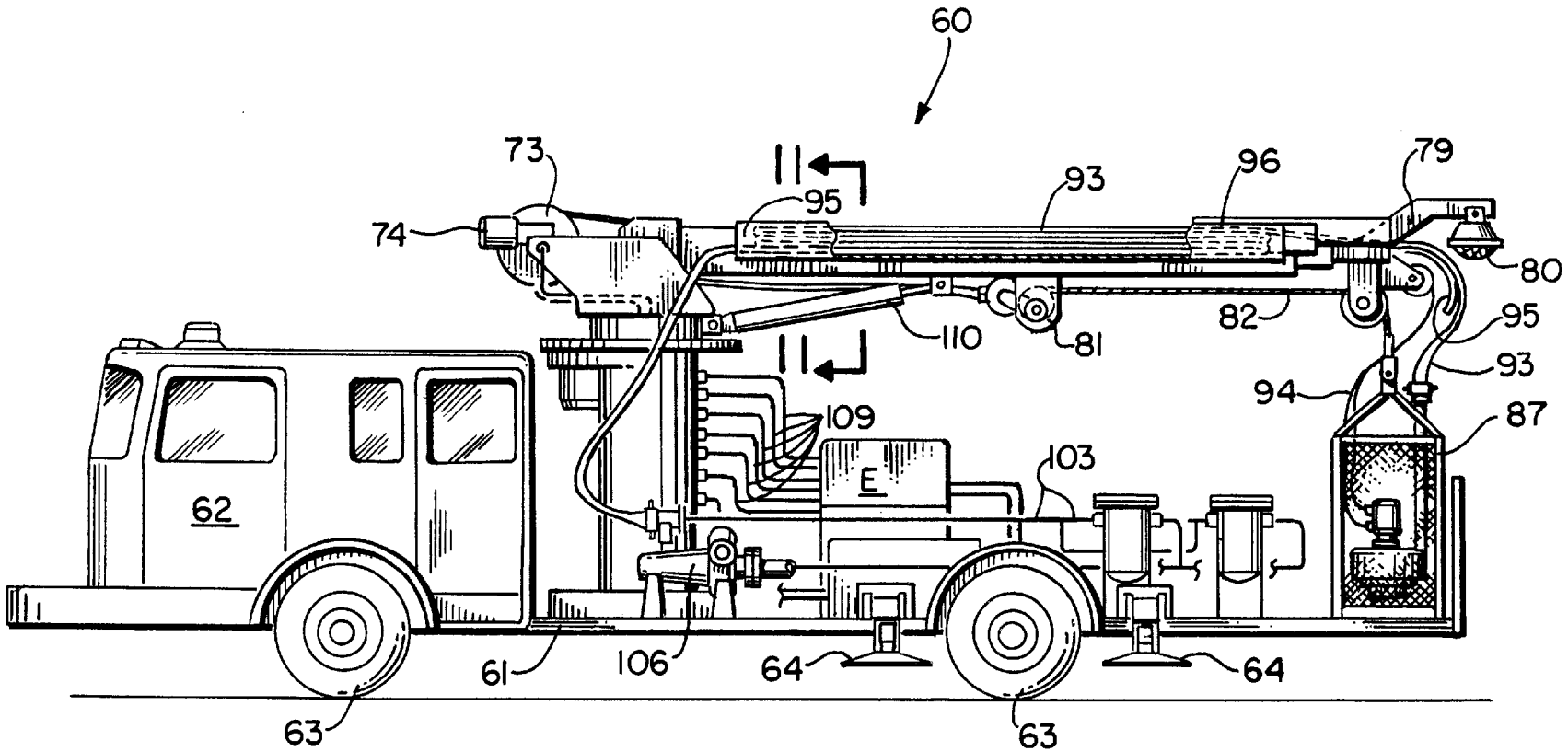
FIG. 9 is an elevation view of the second embodiment of the apparatus of the present invention showing the apparatus in a stored, transport position.
Figure 10:
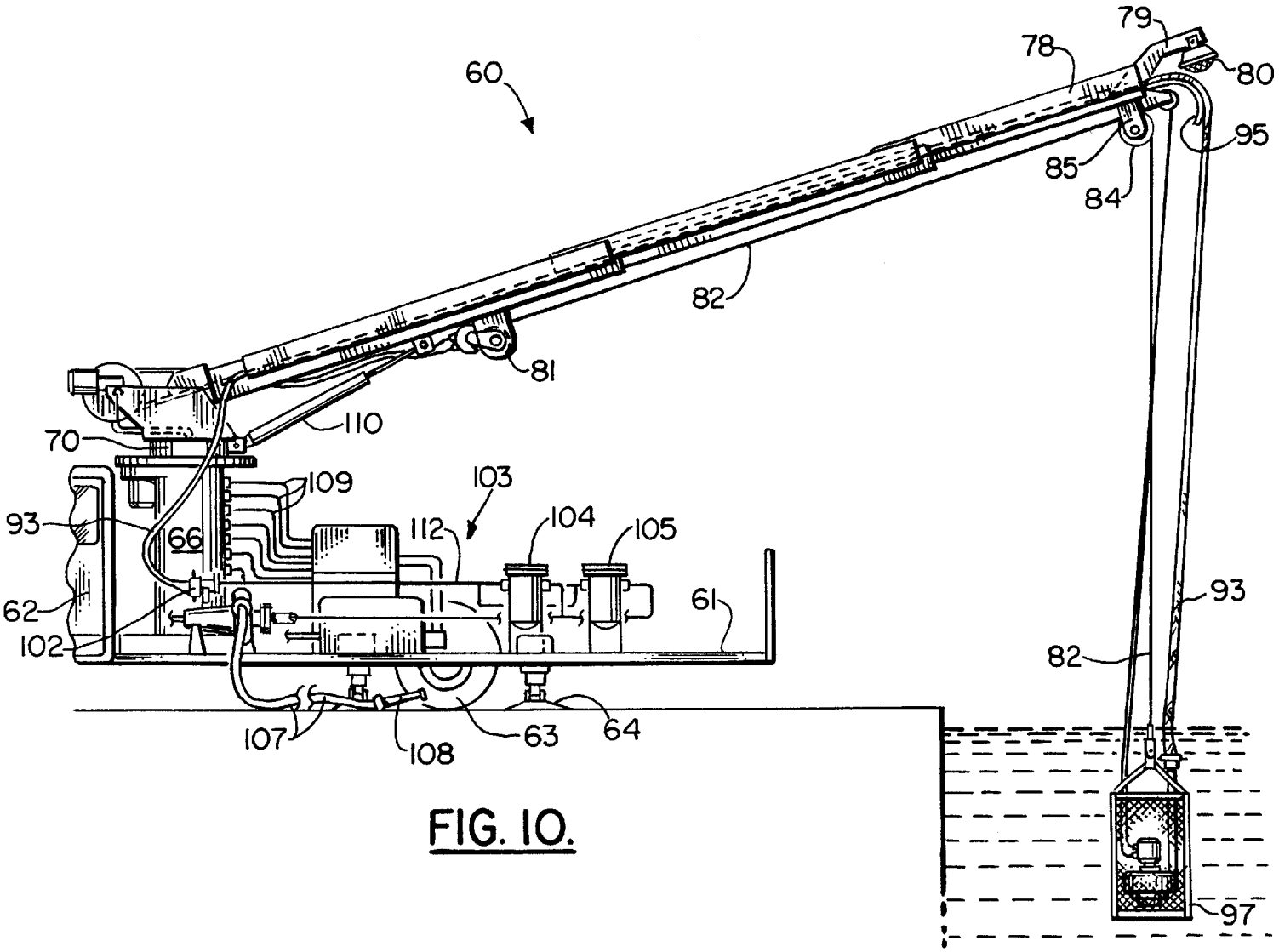
FIG. 10 is an elevation view of the second embodiment of the apparatus of the present invention showing operational position.

A second embodiment of the apparatus of the present invention is shown in FIGS. 9–13, designated generally by the numeral 60 in FIGS. 9 and 10. Fire fighting apparatus 60 includes a chassis 61 such as a fire truck chassis that includes a cab 62. An engine and transmission for propelling chassis 61 can be mounted on chassis 61 near cab 62. The engine near cab 62 can have a power takeoff that can be used to drive some or all of the hydraulic components that are a part of the present invention such as the hydraulic pump 42 and transfer pump. Alternatively, or in supplement to the engine contained in cab 62, an engine 41, E can be used to drive a hydraulic pump 42 that supplies hydraulic fluid under pressure to various hoses 109 that power the various hydraulic components of the apparatus 60, including hydraulic cylinder 110, motor 67 that rotates boom 65, load line winch 81, submersible pump 90, outriggers 14, hydraulic flowline winch motor 74, boom extension hydraulic cylinders, a hydraulic generator, and any hydraulic tools that are used in fire fighting. A valve control panel (not shown) can be used to power these components. Such valve panels and hydraulic control valves are commercially available. As with the embodiment of FIGS. 1–8, an engine (eg. diesel) can power both a hydraulic pump and a transfer pump.

Chassis 61 can include a plurality of wheels 63 some of which are propelled using the engine and transmission positioned on chassis 61 near cab 62. Alternatively, the chassis 61 can be in the form of a trailer as with the embodiment of FIGS. 1–8. Outriggers 64 can be used to structurally support the chassis 61 during use.

An elongated boom 65 is provided mounted upon boom pedestal 66 that is structurally connected to chassis 61. In the second embodiment of FIGS. 9–13, boom 65 is an extendable (eg. telescoping) boom that includes a plurality of boom sections 75, 76, 77. It should be understood that the telescoping boom 65 can be of a number of different sections as selected, such as for example, 2, 3 or more extendable or telescoping sections. In FIG. 13, booms 65 can be rotated relative to chassis 61 using motor drive 67. Motor drive 67 has an upper end portion 68 that can be provided with a gear such as a pinion gear that engages with a correspondingly shaped ring gear on annular flange 69. In this fashion, the upper portion 70 of pedestal 66 defines a rotating portion that supports boom 65. When upper rotating portion 70 is rotated by motor drive 67 and its gearing, boom 65 rotates therewith relative to chassis 61. In FIG. 10, the boom lower end 71 is attached by welding or bolting for example, to upper rotating portion 70 of pedestal 66.

Boom 65 can be hydraulically powered with hydraulic cylinder 110 to elevate to an inclined position such as is shown in FIG. 10. Boom 65 can pivotally attach at pivot 72 to boom lower end 71 as shown in FIG. 13.

Figure 11:
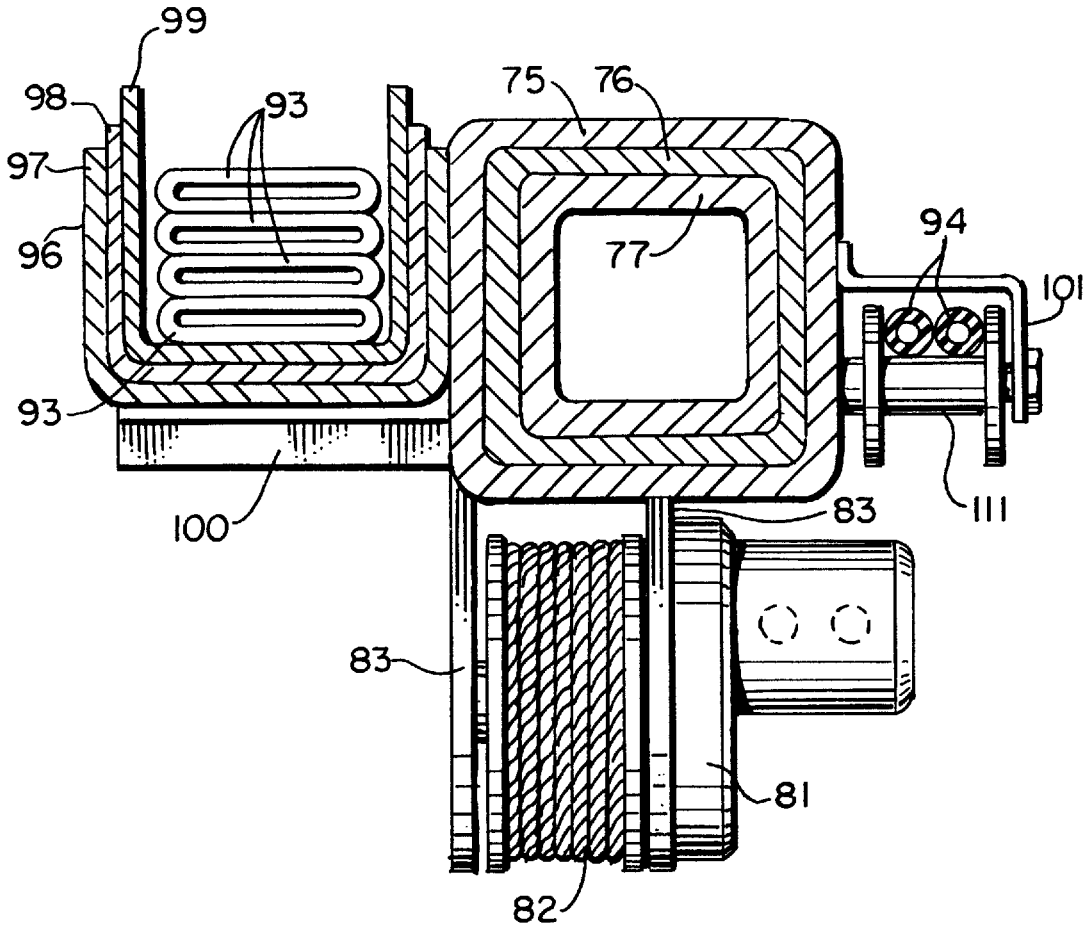
FIG. 11 is a sectional view taken along lines 11—11 of FIG. 9.

Hydraulic lines 94 can be wound upon winch 73. Winch 73 can be controlled with a motor drive 74 that is designed respectively to pay out or reel in hydraulic lines 94 as boom 65 extends to the position of FIG. 10 or retracts to the position of FIG. 9. Boom 65 is thus an extendable or telescoping boom in the second embodiment of FIGS. 9–13. Boom 65 can include for example three boom sections 75, 76, 77 as shown in FIG. 11, each contained within the other as shown.

Boom 65 provides free end portions 78 that carries light fixture 79 and bulb 80 as well as sheave support 85 and sheave 84. The bulb 80 illuminates the work area immediately underneath the free end 78 of boom 65, illuminating any body of water that will receive cage 87 when water is to be pumped for use in fire fighting.

Cage 87 can be handled with a lift cable 82 that is wound upon hydraulic winch 81. Hydraulic winch 81 can be attached to the assembly of boom 65 and hose tray 96 as shown in FIGS. 10 and 11.

Figure 12:
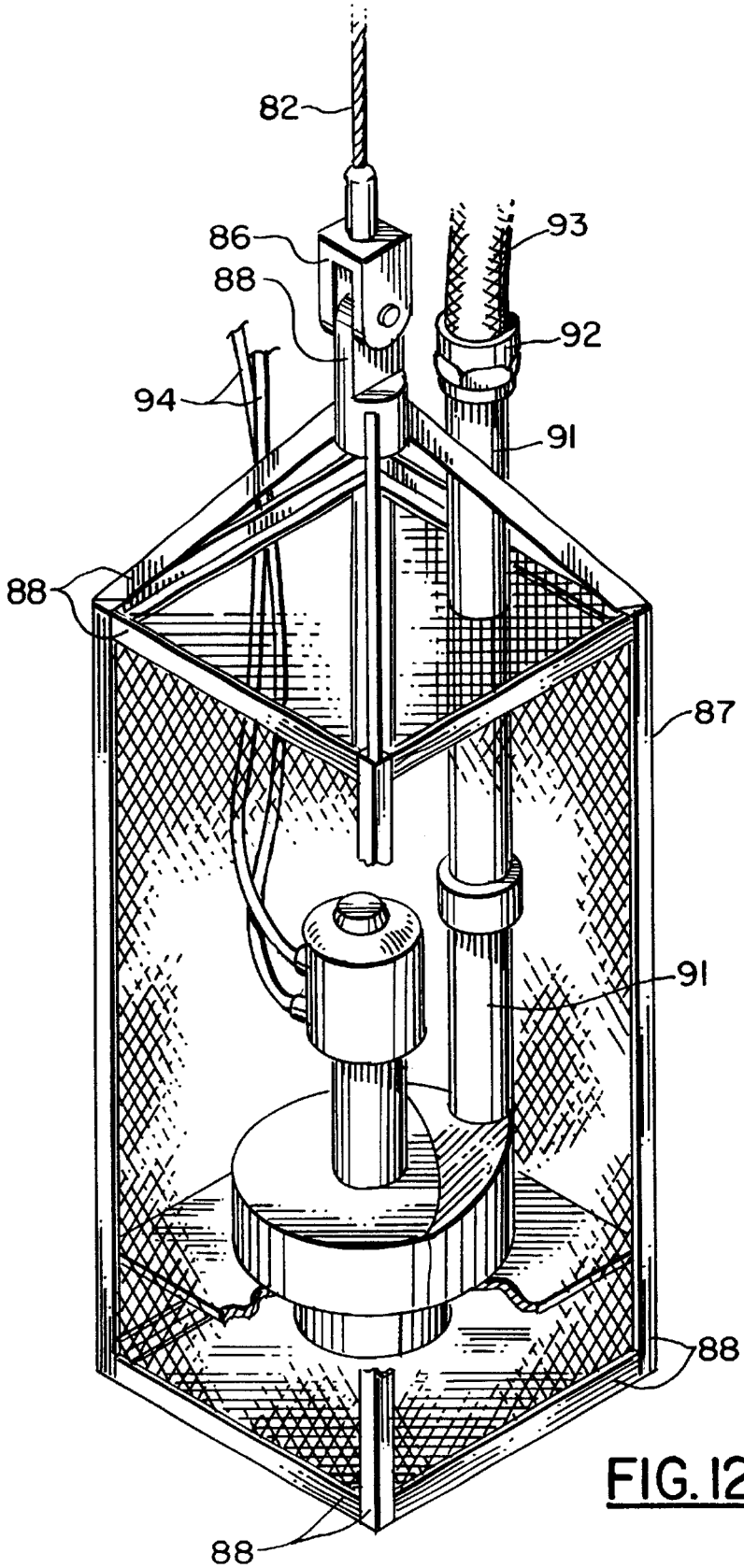
FIG. 12 is a fragmentary perspective, partially cut away view of the second embodiment of the apparatus of the present invention illustrating the pump and cage portions thereof.
Figure 13:
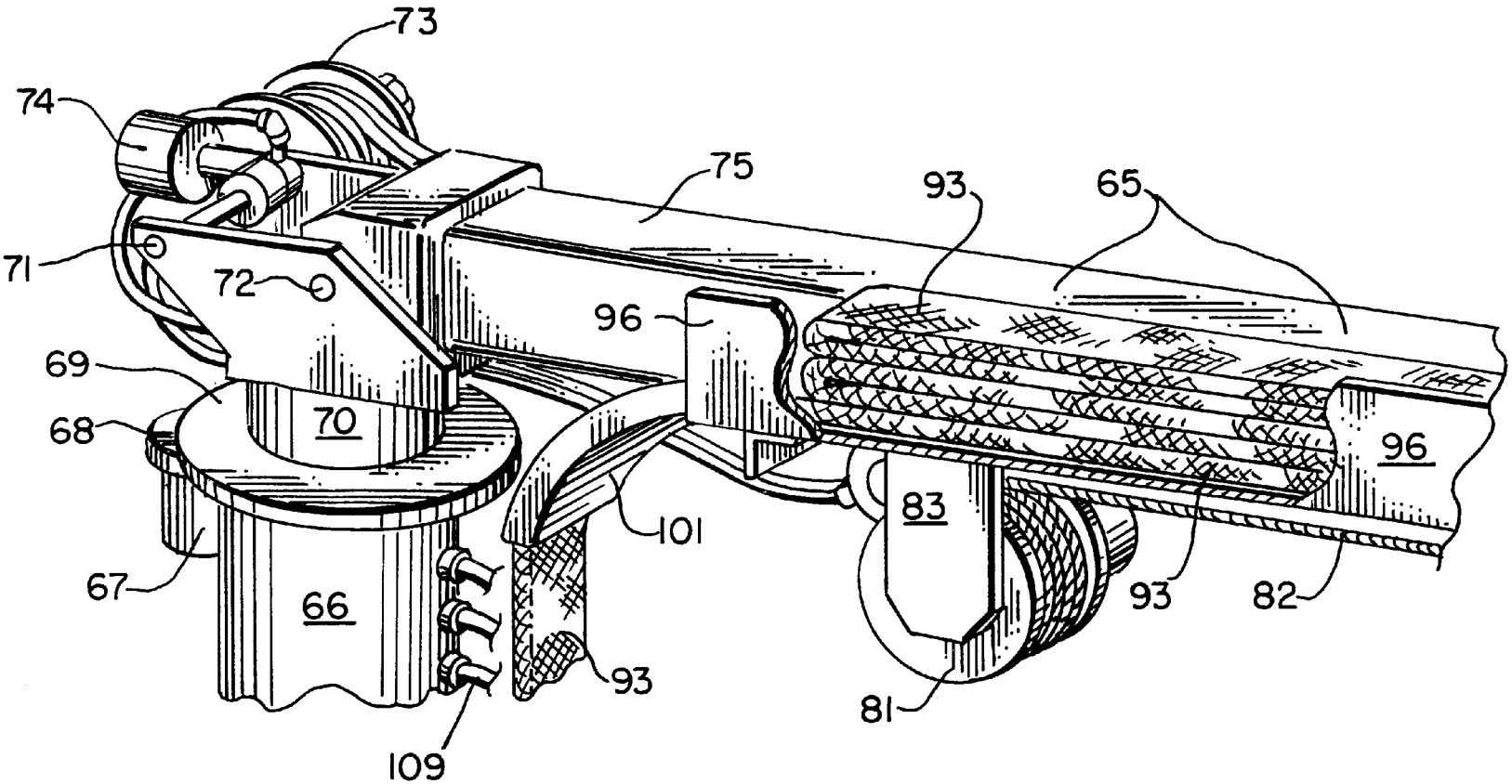
FIG. 13 is a fragmentary perspective view of the second embodiment of the apparatus of the present invention illustrating the boom pedestal, boom and hose tray portions thereof.

Cage 87 is supported at the free end portion of lift cable 82 using shackle 86 as shown in FIG. 12. Cage 87 can be constructed of a structural frame 88 of beams, flanged members, or wide flange shapes. For example, the cage 87 can include a frame 88 of welded angle members of stainless steel, steel, aluminum, or the like. A filter media or screening material such as expanded metal 89 can be used to prevent debris or other particulate material larger than a selected size from entering pump 90.

Hydraulic pump 90 contained within cage 87 is powered with hydraulic flow lines 94. Pump 90 has a discharge flow line 91 with coupling 92 that forms a connection to fire hose 93. The fire hose 93 extends vertically above cage 87 during use as shown in FIG. 10, engaging the free end portion 78 of boom 65 at hose support 95.

Hose tray 96 contains an elongated length of fire hose 93 when in the resting, transport position of FIG. 9. As shown in FIG. 13, the fire hose 93 is simply folded several times inside of hose tray 96. The hose tray 96 can be constructed of a plurality of telescoping tray sections 97, 98, 99 as shown in FIG. 11. When the boom 65 is extended to the position of FIG. 10, the folded fire hose 93 simply unfolds as the boom sections 75, 76, 77 extend fully. The boom 65 can be elevated and lowered using hydraulic cylinder 110. The boom sections 75, 76, 77 can be extended in telescoping fashion using one or more hydraulic cylinders for example that span between adjacent sections 75, 76 or 76, 77.

A hydraulic hose support 101 can include a plurality of rollers 111 at intervals supported along the length of the largest boom section 75. Such a roller 111 and hose support 101 can also be placed at the extreme end portion of the other sections 76, 77, at portions of those sections that do not fully recede into another adjacent boom section.

Fitting 102 connects with an end portion of fire hose 93 that is opposite the end portion of fire hose 93 connected to pump 90 at fitting 92. Hose fitting 102 communicates with a piping system 103 that includes filters 104, 105. Otherwise, the piping system 103 can be the same as shown and described with respect to the preferred embodiment (see FIG. 7). The piping system 103 communicates with and includes pump 106 which is a hydraulic pump for transferring water from the piping system 103 via fire hose 107 and nozzle 108 to a fire where it is used to put out the flames. The pump 106 can be hydraulically powered, or can be powered with a power takeoff from the engine of cab 62 of fire fighting apparatus 60. A plurality of hydraulic hoses 109 can communicate with engine E for providing hydraulic power to. the various components of the apparatus 60 of the present invention including motor 74 and winch 73, winch 81, hydraulic cylinder 110, and the hydraulic cylinders that extend and retract the boom sections 75, 76, 77 of boom 65.

PARTS LIST

| PART NO. | DESCRIPTION |
|---|---|
| 10 | fire fighting apparatus |
| 11 | trailer |
| 12 | truck |
| 13 | wheel |
| 14 | outrigger |
| 15 | frame |
| 16 | upper surface |
| 17 | segmented boom |
| 18 | pedestal |
| 19 | boom section |
| 20 | boom section |
| 21 | boom section |
| 22 | boom section |
| 23 | boom section |
| 24 | hydraulic cylinder |
| 25 | hydraulic submersible pump |
| 26 | arrow |
| 27 | pivotal connection |
| 28 | pivotal connection |
| 29 | pivotal connection |
| 30 | pivotal connection |
| 31 | pivotal connection |
| 32 | body of water |
| 33 | water surface |
| 34 | fence |
| 35 | arrow |
| 36 | soil mass |
| 37 | hydraulic cylinder |
| 38 | hydraulic cylinder |
| 39 | arrow |
| 40 | arrow |
| 41 | diesel engine |
| 42 | hydraulic pump |
| 43 | transfer pump |
| 44 | filter |
| 45 | filter |
| 46 | flowline |
| 47 | flowline |
| 48 | hose |
| 49 | nozzle |
| 50 | telescoping portion |
| 51 | pinion |
| 52 | rack |
| 53 | arrow |
| 54 | hydraulic line |
| 55 | tip |
| 56 | ice |
| 60 | fire fighting apparatus |
| 61 | chassis |
| 62 | cab |
| 63 | wheel |
| 64 | outrigger |
| 65 | boom |
| 66 | pedestal |
| 67 | motor drive |

-continued

PARTS LIST

| PART NO. | DESCRIPTION |
|---|---|
| 68 | upper end |
| 69 | annular flange |
| 70 | upper rotating portion |
| 71 | boom lower end |
| 72 | pivot |
| 73 | winch |
| 74 | motor drive |
| 75 | boom section |
| 76 | boom section |
| 77 | boom section |
| 78 | free end portion |
| 79 | light fixture |
| 80 | bulb |
| 81 | hydraulic winch |
| 82 | lift cable |
| 83 | winch support |
| 84 | sheave |
| 85 | support |
| 86 | shackle |
| 87 | cage |
| 88 | frame |
| 89 | filter media |
| 90 | hydraulic pump |
| 91 | discharge flowline |
| 92 | coupling |
| 93 | fire hose |
| 94 | hydraulic flow line |
| 95 | hose support |
| 96 | hose tray |
| 97 | tray section |
| 98 | tray section |
| 99 | tray section |
| 100 | boom |
| 101 | hose support |
| 102 | fitting |
| 103 | piping system |
| 104 | filter |
| 105 | filter |
| 106 | pump |
| 107 | fire hose |
| 108 | nozzle |
| 109 | hydraulic hose |
| 110 | hydraulic cylinder |
| 111 | roller |
| 112 | flowline |
| E | engine |
| V | valve |

The foregoing embodiments are presented by way of example only; the scope of the present invention is to be limited only by the following claims.

What is claimed is:

1. A fire fighting apparatus comprising:

a) a chassis;

b) a crane pedestal mounted on the chassis;

c) a boom mounted on the pedestal; the boom having a free end portion;

d) an engine mounted on the chassis;

e) a hydraulic pump that is driven by the engine;

f) a submersible pump supported at the free end portion of the boom;

g) hydraulic flowlines interfacing the submersible pump and hydraulic pump for operating the submersible hydraulic pump;

h) a water conveying flowline for conveying water from the submersible hydraulic pump to the chassis; and i) a transfer pump on the chassis for receiving water from the water conveying flowline and submersible pump, the transfer pump having a discharge fitting that enables connection to a fire fighting hose and nozzle.

2. The apparatus of claim 1 further comprising a pair of filters that filter flow between the submersible pump and the transfer pump, the filters being piped to be alternatively cleaned so that the filters can be cleaned during operation of fire fighting.

3. The apparatus of claim 1 wherein the boom is an articulating boom.

4. The apparatus of claim 1 wherein the boom is an extendable boom.

5. The apparatus of claim 4 wherein the boom is a telescoping boom.

6. The apparatus of claim 1 wherein the boom comprises a plurality of connected boom sections.

7. The apparatus of claim 1 wherein the boom includes a plurality of boom sections and a plurality of connections joining the boom.

8. The apparatus of claim 4 wherein the water conveying flowline is a folded hose and can elongate when the boom is extended.

9. The apparatus of claim 8 further comprising a hose tray for supporting the hose.

10. A fire fighting apparatus comprising:

a) a chassis;

b) a crane pedestal mounted on the chassis;

c) an articulating boom mounted on the pedestal, the boom including a plurality of boom sections and a plurality of pivotal connections joining the boom sections together end to end;

d) hydraulic cylinders for elongating the boom;

e) an engine mounted on the chassis;

f) a hydraulic motor that is driven by the chassis and for operating the hydraulic cylinders that elongate the boom;

g) a submersible pump mounted at an end portion of the boom opposite the pedestal;

h) hydraulic flowlines for operating the hydraulic cylinders and the submersible hydraulic pump;

i) water conveying flowlines for conveying water from the submersible hydraulic pump to the chassis; and j) a transfer pump on the chassis for receiving water from the water flowlines and submersible pump, the transfer pump having a discharge that communicates with a fire fighting hose and nozzle.

11. A fire fighting apparatus comprising:

a) a chassis;

b) a pedestal mounted on the chassis;

c) a boom mounted on the pedestal, the boom having a free end portion;

d) a powered hydraulic pump;

e) a submersible pump supported at the free end portion of the boom;

f) hydraulic flowlines interfacing the submersible pump and hydraulic pump for operating the submersible hydraulic pump;

g) a water conveying flowline for conveying water from the submersible hydraulic pump to the chassis; and h) a transfer pump on the chassis for receiving water from the water conveying flowline and submersible pump, the transfer pump having a discharge fitting that enables connection to a fire fighting hose and nozzle.

12. The apparatus of claim 11 further comprising at least one filter that filters flow between the submersible pump and the transfer pump.

13. The apparatus of claim 11 wherein the boom is an articulating boom.

14. The apparatus of claim 11 wherein the boom is an extendable boom.

15. The apparatus of claim 14 wherein the boom is a telescoping boom.

16. The apparatus of claim 11 wherein the boom comprises a plurality of connected boom sections.

17. The apparatus of claim 11 wherein the boom includes a plurality of boom sections and a plurality of connections joining the boom.

18. The apparatus of claim 14 wherein the water conveying flowline is a folded hose and can elongate when the boom is extended.

19. The apparatus of claim 18 further comprising a hose tray for supporting the hose.

20. A fire fighting apparatus comprising:

a) a chassis with a pedestal;

b) a boom mounted on the chassis, the boom including a plurality of boom sections;

c) a hydraulic motor that is mounted on the chassis;

d) a submersible pump mounted at an end portion of the boom opposite the pedestal;

e) hydraulic flowlines for operating the hydraulic cylinders and the submersible hydraulic pump;

f) water conveying flowlines for conveying water from the submersible hydraulic pump to the chassis; and g) a transfer pump on the chassis for receiving water from the water flowlines and submersible pump, the transfer pump having a discharge that communicates with a fire fighting hose and nozzle.

* * * * *